US010931024B2

(12) United States Patent
Milroy et al.

(10) Patent No.: US 10,931,024 B2
(45) Date of Patent: Feb. 23, 2021

(54) LINEAR-TO-CP POLARIZER WITH ENHANCED PERFORMANCE IN VICTS ANTENNAS

(71) Applicant: ThinKom Solutions, Inc, Hawthorne, CA (US)

(72) Inventors: William Milroy, Torrance, CA (US); Alan C. Lemons, San Pedro, CA (US)

(73) Assignee: ThinKom Solutions, Inc., Hawthorne, CA (US)

( * ) Notice: Subject to any disclaimer, the term of this patent is extended or adjusted under 35 U.S.C. 154(b) by 0 days.

(21) Appl. No.: 16/369,483

(22) Filed: Mar. 29, 2019

(65) Prior Publication Data

US 2020/0313303 A1 Oct. 1, 2020

(51) Int. Cl.
*H01Q 15/24* (2006.01)
*H01Q 21/00* (2006.01)

(52) U.S. Cl.
CPC ..... *H01Q 15/244* (2013.01); *H01Q 15/246* (2013.01); *H01Q 21/0006* (2013.01)

(58) Field of Classification Search
CPC . H01G 15/244; H01G 15/246; H01G 21/0006
See application file for complete search history.

(56) References Cited

FOREIGN PATENT DOCUMENTS

CN 108155483 A * 6/2018
GB 1416343 A 12/1975

OTHER PUBLICATIONS

Joyal et al., "Design and Analysis of a Cascade Circular Polarization Selective Surface at K Band," IEEE Transactions on Antennas and Propagation, vol. 62, No. 6, pp. 3043-3053, Mar. 11, 2014.
European Search Report and European Search Opinion from corresponding European Patent Application No. 20162667, dated Jun. 17, 2020.

* cited by examiner

*Primary Examiner* — Graham P Smith
(74) *Attorney, Agent, or Firm* — Kusner & Jaffe

(57) ABSTRACT

A linear-to-circular polarizer includes a meanderline polarizer having a plurality of meanderline conductor patterns, and a gridline polarizer having a plurality of conductors arranged in a grid pattern. The gridline polarizer is spaced apart from the meanderline polarizer by a first prescribed distance and the gridline polarizer is spaced apart from a planar antenna aperture of a planar antenna by a second prescribed distance.

22 Claims, 5 Drawing Sheets

LINEAR-TO-CP POLARIZER WITH ENHANCED PERFORMANCE IN VICTS ANTENNAS

TECHNICAL FIELD

The present invention relates generally to polarizers, and more particularly, to a linear-to-circular polarizer for use in antenna systems.

BACKGROUND ART

For traditional phased array antennas, one method of achieving circular polarization includes using dual-linear polarized array elements combined with 90-degree hybrid networks incorporated within the antenna feed. Such hybrid networks provide the necessary power split and phase shift between radiated linearly-polarized field components to achieve circular polarization. However, this technique can degrade axial ratio (polarization purity) performance at frequency and scan angle extremes due to element cross-polarization contamination and reduced network performance at band edges.

Another method for achieving circular polarization for traditional phased arrays is through the use of a multi-layer meanderline polarizer. Such a method offers a proven viable alternative approach that does not require expensive dual polarized array elements or hybrid feed networks. Using this approach, the polarizer, which is typically fabricated using low loss, low cost printed circuit board techniques, is permanently affixed to the radiating array aperture. As linear polarized waves emanating from the array travel through the polarizer the electric field resolves into two orthogonal components, one parallel to the meanderline axis and one perpendicular to the meanderline axis. The component parallel to the meanderline axis experiences an inductive shunt load leading to a positive transmitted phase shift, while the component perpendicular to the meanderline axis experiences a shunt capacitive load leading to a negative transmitted phase shift. The combined radiated electric field is elliptically polarized achieving either right-hand elliptical polarization or left-hand elliptical polarization depending on the rotation angle of the meanderline axis. The radiating polarization is more commonly described in industry as being 'circularly polarized' (either right-hand circular polarization (RHCP) or left-hand circular polarization (LHCP)) with an axial ratio greater than 1.

While affixing a multi-layer meanderline polarizer to the top of a traditional phased array can provide circular polarization with less complexity than the dual-polarized element/hybrid feeding approach, the multi-directional scan nature of traditional phased arrays tend to limit full exploitation of the meanderline's unique properties, reducing their combined use to applications in which limited scan ranges are required.

SUMMARY OF INVENTION

Today's geostationary equatorial orbit (GEO), medium earth orbit (MEO), and low earth orbit (LEO) satellite and ground terrestrial communication systems are required by both military and commercial markets to meet stringent cross-polarization isolation requirements over wide frequency ranges and large antenna scan volumes (e.g., 0 degrees to 85 degrees). These cross-polarization requirements correspond to similarly stringent axial ratio requirements.

A problem of limited scan volume of conventional antenna systems is addressed with a novel approach described herein where a scanning antenna, such as a Variable Inclination Continuous Transverse Stub (VICTS) antenna, is combined with a novel polarizer in accordance with the present invention. Such combination produces diverse polarization performance over a near-hemispherical scan volume that can meet current cross-polarization isolation requirements. In particular, performance over large scan angles is superior to conventional devices, including improvement in both transmit efficiency and polarization purity.

A device in accordance with the present invention combines a meanderline polarizer with a gridline polarizer to form a novel polarizer capable of providing either linear, right-hand, or left-hand circular polarization in one low profile, low cost entity. The respective polarizer portions can be formed as a multi-layer meanderline polarizer and a multilayer gridline polarizer. The novel polarizer has particular utility with scanning antennas, such as, for example, a VICTS antenna or other scanning antenna. The VICTS antenna combined with a simple "grid" polarizer provide "complementary" scan and polarization properties to the scan and polarization properties of the meanderline polarizer, such that when all three elements are located in close proximity to one another, enable full exploitation of the meanderline polarizer's full set of polarization attributes (e.g. low loss, low axial ratio, wide scan, etc.).

More particularly, the gridline polarizer can pre-adjust the angle of the linear polarization vector emanating from the VICTS antenna such that when combined with the meanderline polarizer, optimum cross-polarization performance is achieved. Since VICTS antennas provide a near-hemispherical scan volume, nominal polarization performance can be achieved over this same volume. Advantageously, the device offers selectable polarization characteristics that can meet the needs of multiple satellite constellations.

According to one aspect of the invention, a linear-to-circular radio frequency (RF) polarizer includes: a meanderline polarizer including a plurality of meanderline conductor patterns; and a gridline polarizer including a plurality of conductors arranged in a grid pattern, wherein the gridline polarizer is spaced apart from the meanderline polarizer by a first prescribed distance and the gridline polarizer is spaced apart from a planar antenna aperture of a planar antenna by a second prescribed distance.

In one embodiment, the polarizer includes the planar antenna.

In one embodiment, the meanderline polarizer and the gridline polarizer are concentric with one another.

In one embodiment, the meanderline polarizer and the gridline polarizer are rotatable relative to one another about a common axis.

In one embodiment, the meanderline polarizer and the gridline polarizer comprise a circular form factor.

In one embodiment, the polarizer includes a motive device operatively coupled to at least one of the meanderline polarizer or the gridline polarizer, the motive device operative to impart relative rotation between the gridline polarizer and the meanderline polarizer about a common axis.

In one embodiment, the motive device comprises a motor and at least one of a belt drive, a gear drive, direct drive, or a spindle coupling the motor to at least one of the gridline polarizer or the meanderline polarizer.

In one embodiment, the polarizer includes a spindle, wherein the meanderline polarizer and the gridline polarizer are connected to spindle and axially rotatable about the spindle.

In one embodiment, the meanderline polarizer includes a plurality of layers stacked one above the other, each layer including a plurality of meanderline conductor patterns.

In one embodiment, the gridline polarizer includes a plurality of layers, each layer including a plurality of conductors arranged in a grid pattern.

In one embodiment, a spacing between adjacent gridlines of the gridline polarizer is equal throughout the grid pattern.

In one embodiment, the gridlines of the gridline polarizer are parallel to one another.

In one embodiment, at least one of the meanderline polarizer or the gridline polarizer comprises at least one dielectric spacer arranged between adjacent layers of the respective polarizer.

In one embodiment, the dielectric spacer comprises at least one of air or low-density foam.

In one embodiment, the meanderline conductor pattern comprises at least one of a sinusoidal pattern, a curvilinear pattern or a square wave pattern.

In one embodiment, the meanderline polarizer comprises a first substrate and the gridline polarizer comprises a second substrate, and the meanderline conductor pattern is formed on the first substrate and the conductors arranged in a grid pattern are formed on the second substrate.

According to another aspect of the invention an antenna system includes a scanning antenna including an aperture and feed, and the polarizer described herein, wherein the scanning antenna is arranged relative to the polarizer to communicate RF signals between the aperture and the polarizer.

In one embodiment, the scanning antenna comprises a variable inclination continuous transverse stub (VICTS) antenna.

In one embodiment, the scanning antenna is spaced apart from the gridline polarizer by a prescribed distance.

In one embodiment, the gridline polarizer is arranged between the meanderline polarizer and the scanning antenna.

In one embodiment, the antenna system includes a motive device operatively coupled to at least one of the meanderline polarizer, the gridline polarizer or the scanning antenna, the motive device operative to provide relative motion between at least two of the meanderline polarizer, the gridline polarizer or the scanning antenna.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features.

DETAILED DESCRIPTION OF INVENTION

Figure 1:
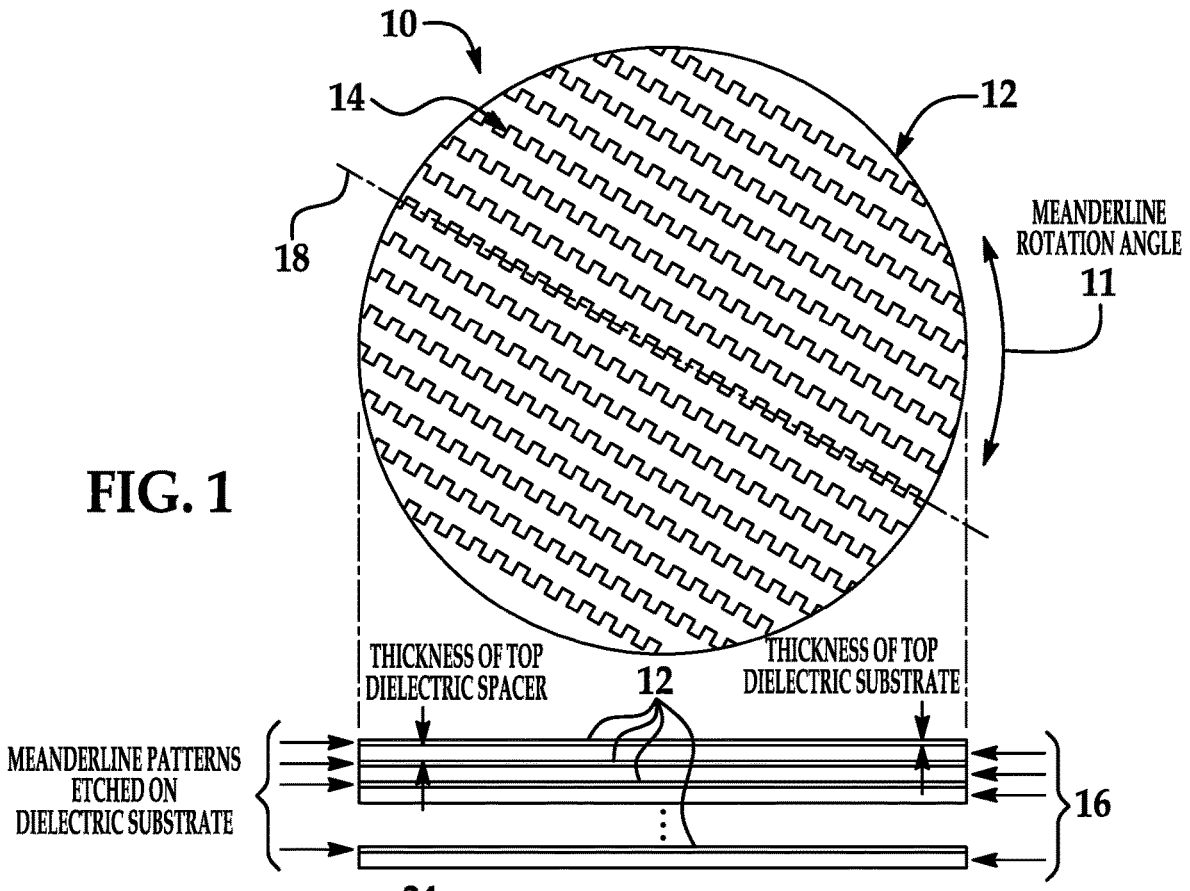
FIG. 1 illustrates an exemplary meanderline polarizer with a periodic meanderline pattern.

Embodiments of the present invention will now be described with reference to the drawings, wherein like reference numerals are used to refer to like elements throughout. It will be understood that the figures are not necessarily to scale.

The present invention finds utility in Variable Inclination Continuous Transverse Stub (VICTS) antenna systems and therefore will be described chiefly in this context. However, aspects of the invention are also applicable to other scanning planar antenna systems, including but not limited to electronically-scanned slotted planar arrays, printed patch arrays, open-ended waveguide arrays, or the like.

A VICTS antenna in its simplest form includes two components, namely an aperture and a feed. Antenna main beam scanning in $\theta$ is achieved via rotation of the aperture with respect to the feed. This type of rotation also scans the antenna main beam over a small range of $\Phi$ (azimuth), while additional desired scanning in $\Phi$ is achieved by rotating the aperture and feed simultaneously, leading to near hemispherical scan coverage.

In accordance with the invention, a multi-layer meanderline polarizer having a plurality of meanderline conductor patterns is combined with a gridline polarizer having a plurality of conductors arranged in a grid pattern to provide optimum axial ratio over frequency and scan. Conventionally, a gridline polarizer is used solely for linearly-polarized applications, whereas a meanderline polarizer is used solely for circularly-polarized applications. The former generally does not require the latter (no CP performance required, by definition) and the latter generally does not require the former (as the incoming RF plane-wave incident on the meanderline polarizer is (by definition) already linear). The novel combination of the two is applicable when the meanderline polarizer is conformally placed very close to (less than ¼ wavelength) from a complex planar array surface. For the special case of a non-scanning planar array antenna (including but not limited to continuous transverse stub (CTS)), the novel addition of the gridline polarizer allows for favorable suppression of non-radiating high-order "evanescent" modes which would otherwise couple (due to the very close proximity of the polarizer) and (1) degrade the cross-polarization isolation characteristics of the outgoing wave and (2) result in RF losses and pattern degradation associated with coupled surface waves, in the antenna/meanderline polarizer ensemble. Further, in the case of a scanning planar array (including but not limited to "VICTS",) the novel addition of the gridline polarizer (and the added design degrees of freedom associated with optimal selection of the spacing and rotational orientation of the gridline relative to the planar array aperture below and the meanderline polarizer above) significantly improves the cross-polarization isolation of the ensemble, particularly at larger scan angles where undesired coupling to higher-order modes associated with the scanning would otherwise degrade overall performance of if the grid polarizer were not present, as compared to "standard" meanderline polarizer embodiments.

The multi-layer meanderline polarizer's and the gridline polarizer's conductor dimensions, internal dielectric substrate separation and thickness, and their respective rotation angles as well as the meanderline to gridline polarizer spacing and the gridline polarizer to VICTS aperture spacing are designed to work with the VICTS antenna to provide electric field component magnitude and phasing that achieves optimum axial ratio performance and impedance match over frequency and scan angle. As part of the design process both the meanderline rotation angle and the gridline rotation angle for achieving optimum axial ratio versus scan angle are synchronized with the antenna main beam position $\Phi$ angle-profile versus VICTS scan angle, $\theta$.

A multi-layer meanderline polarizer is a device that, when added to the radiating face of an aperture antenna, achieves various polarization states by converting the (usually linear) polarization emanating from the aperture to another polarization state (usually either elliptical or linear polarization). A meanderline polarizer is generically defined as a passive RF structure that includes two or more thin dielectric substrate layers, upon each of which is printed/etched a one-dimensional array of parallel conductive "meandering" ("square-wave-like") trace/patterns such that each layer exhibits anisotropic (polarization-orientation-dependent) properties. The RF insertion phase (phase difference between incident and transmitted waves) for incident plane waves with linear polarization aligned parallel to the axis of the meanderline favorably differ from the RF insertion phase for incident plane waves aligned orthogonal to the meanderline axes. Based on this phase differential, multiple layers are employed to achieve the desired net differential phase (typically 90 degrees for linear-to-circular polarizer applications.)

With reference to FIG. 1, an exemplary multi-layer meanderline polarizer 10 is shown that includes one or more dielectric substrates (layers) 12 each possessing a plurality of periodic meanderline conductor patterns 14 laterally spaced apart from one another. While the conductor pattern 14 of the meanderline polarizer 10 is illustrated as a square wave pattern, other patterns are possible. For example, the meanderline conductor pattern 14 may be sinusoidal or curvilinear. Further, there is some benefit (in some cases, particularly when an odd number of substrates are employed) to employ a different (higher phase differential) pattern on the center-most substrates as compared to the outer-most substrates (lower phase differential.) This is generally (but not always) done in order to fully optimize (minimize) the RF reflection properties of the multi-layer polarizer.

The conductor patterns 14 can be fabricated using various techniques, such as etching them on the dielectric substrates 12 using printed circuit board manufacturing processes. The substrates 12 can be formed from conventional materials, such as plastic materials or the like. Dielectric spacers 16, such as low density foam, air or the like, are arranged between adjacent substrates 12 and can maintain the spacing between adjacent substrates 12. "Low density dielectric foam" is generally recognized as an engineered foam comprised of a common dielectric material (polyethylene, polystyrene, polypropylene, etc. generally with dielectric constants between 2 and 3.5) and air with an effective dielectric constant of 1.4 or lower (air is 1.0). The dimensions of the meanderline conductor pattern 14 along with the thicknesses of the dielectric substrates 12 and spacers 16 can be adjusted to achieve optimum impedance match and polarization purity. A meanderline axis 18, which is an imaginary line drawn parallel to the conductor pattern 14, is shown in FIG. 1.

A grid-type, or "gridline", polarizer is a device that when added to the radiating face of an aperture antenna achieves various polarization states by converting the (usually linear) polarization emanating from the aperture to another polarization state (usually rotated linear polarization). A gridline polarizer is generically defined as a passive RF structure that includes one or more thin dielectric substrate layers, upon each of which is printed/etched a closely spaced (e.g., ¼ wavelength or less) one-dimensional array of parallel conductive lines such that the/each layer exhibits anisotropic (polarization-orientation-dependent) properties. Incident waves with linear polarization aligned parallel to the conductive lines are highly (95% or more) reflected (i.e. 5% or less transmitted) whereas incident waves with linear polarization aligned orthogonal to the conductive lines are largely (95% or more) transmitted (i.e. 5% or less reflected.)

Figure 2:
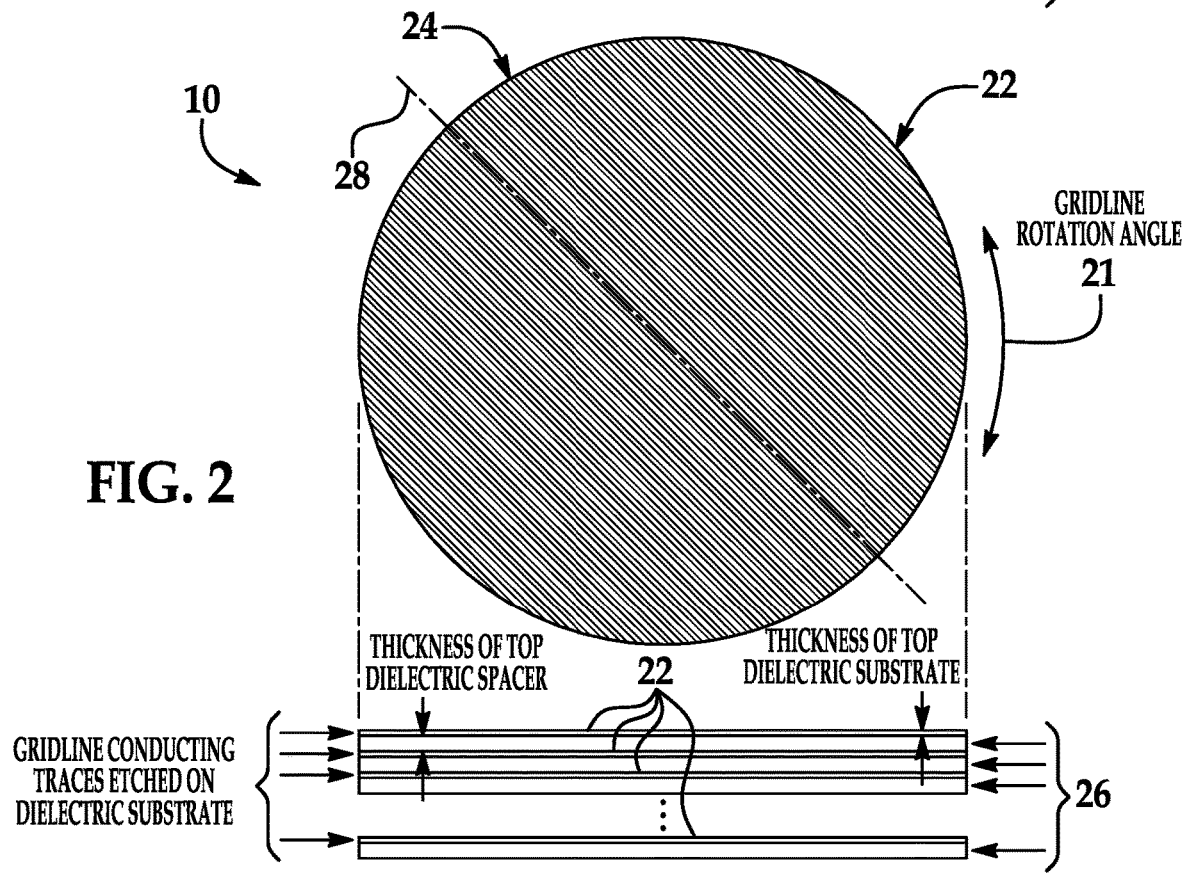
FIG. 2 illustrates an exemplary gridline polarizer with periodic parallel conducting traces.

Referring to FIG. 2, illustrated is an exemplary grid-type polarizer 20 that includes one or more dielectric substrates (layers) 22 each possessing a periodically spaced pattern of parallel conducting traces 24 of finite width separated by dielectric spacers 26 (e.g., low density foam, air, etc.). The substrates 22 also can be formed using conventional materials, such as plastic materials or the like. The conducting traces 24, which preferably are parallel to one another, can be fabricated using various techniques such as etching metal-clad dielectric substrates using printed circuit board manufacturing processes. The dimensions of and spacing between the conducting traces 24 along with the thicknesses of the dielectric substrates 22 and spacers 26 can be adjusted to achieve optimum impedance match and polarization purity. In one embodiment, the spacing between adjacent gridlines of the gridline polarizer is equal throughout the grid pattern. In another embodiment, the spacing is unequal, e.g., at least two different spacings are used for different groups of traces. In yet another embodiment, the gridline spacing on each substrate is different (e.g., substrate "A" has a spacing between adjacent gridlines of "x", while substrate "B" has a spacing between adjacent gridlines of "y", where y is not equal to x). A gridline axis 28, which is an imaginary line drawn parallel to the conducting traces 24, is shown in FIG. 2.

While it is common to keep the substrate spacing identical, there can be some benefit in employing different inter-substrate spacing in order to improve transmission properties (reduce reflections) and/or to enhance producibility. Even in cases where the same substrate spacing is used between layers in the gridline polarizer and/or identical substrate spacing between layers in the meanderline polarizer, the spacing between the gridline polarizer and the antenna/array aperture (below) and the spacing between the gridline polarizer and the meanderline polarizer (above) are generally different. The former has a strong impact on transmission efficiency (minimization of undesired mismatch reflections) whereas the latter has a strong impact on polarization-purity (aka "Axial Ratio").

Figure 3:
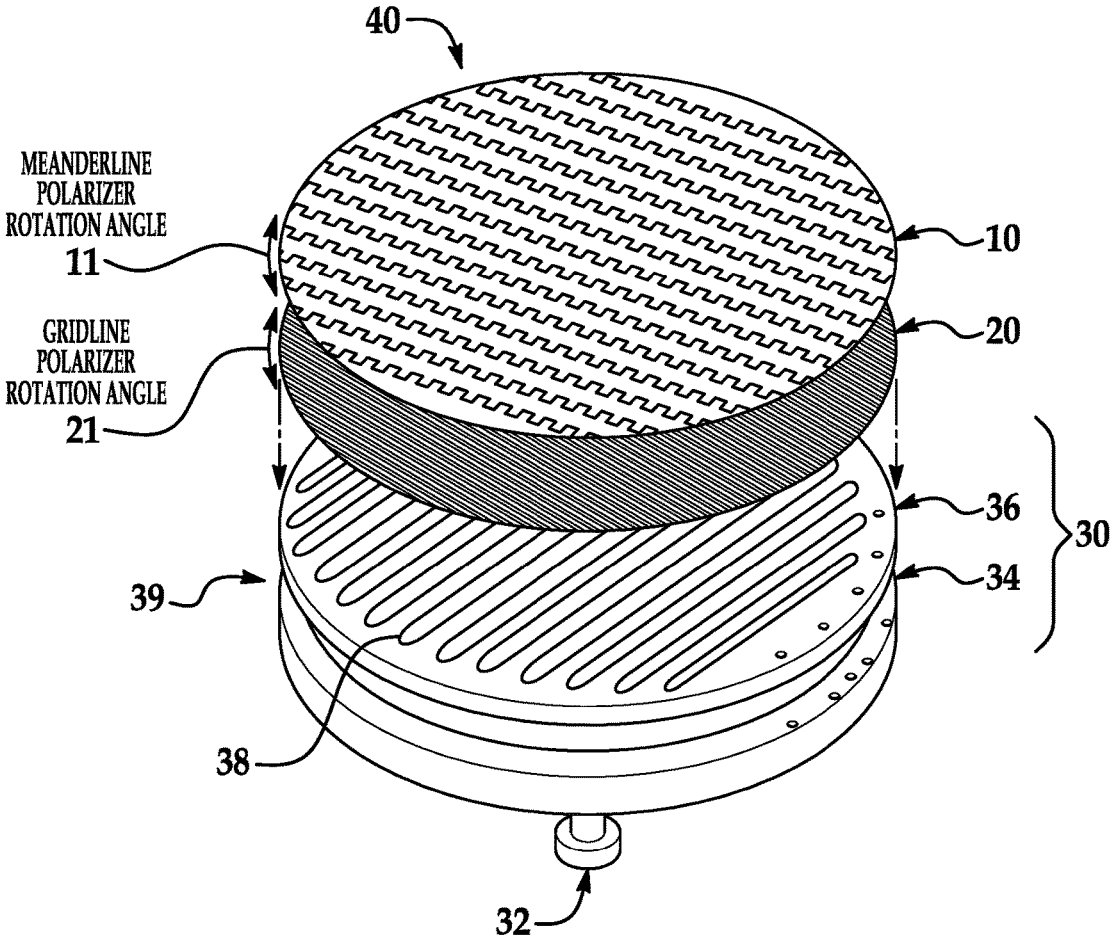
FIG. 3 illustrates an exploded view of an exemplary combined meanderline polarizer, grid polarizer and VICTS antenna in accordance with the invention.
Figure 4:
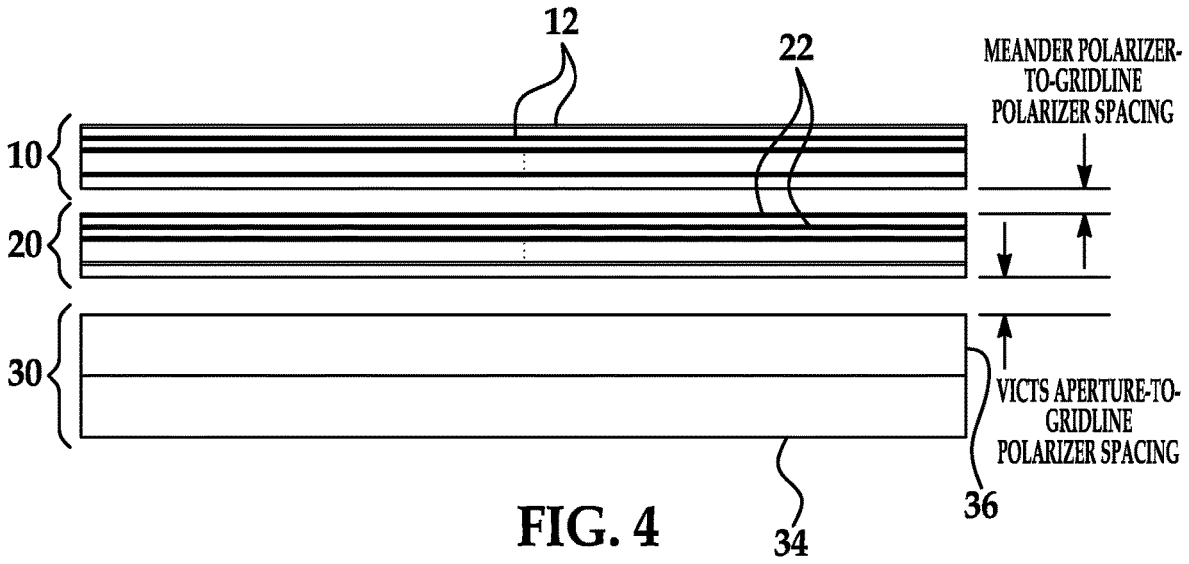
FIG. 4 is a side view of the antenna system of FIG. 3.

With additional reference to FIGS. 3 and 4, illustrated is an exploded view (FIG. 3) and a side view (FIG. 4) of a combination of the meanderline polarizer 10, the gridline polarizer 20, and a VICTS antenna 30 in accordance with the present invention. As shown, the meanderline polarizer 10, gridline polarizer 20 and VICTS antenna 30 each have a circular form factor. While other form factors are possible, due to the relative-rotation capability of the polarizers with respect to each other and to the VICTS antenna 30, a circular form factor is best suited for minimizing the overall size of the system while at the same time providing optimal performance. It is preferable that the meanderline polarizer 10 and the gridline polarizer 20 are concentric with one another. The VICTS antenna 30 also may be concentric with the meanderline and gridline polarizers.

The VICTS antenna 30 includes an antenna port 32 for receiving/outputting an RF signal, and lower and upper conducting plates 34 and 36 as is conventional. The upper conducting plate 36 includes a plurality of stubs 38 that define an aperture 39 of the VICTS antenna 30. The combination of the meanderline polarizer 10, gridline polarizer 20 and VICTS antenna 30 forms a unique antenna device 40 that provides multiple polarization states over a near hemispherical scan volume. The gridline polarizer 20 serves to pre-adjust the rotation angle of the direction of the polarization vector emanating from the VICTS antenna 30 while the meanderline polarizer 10 transforms this pre-adjusted linearly polarized wave emanating from the gridline polarizer into an elliptically polarized wave. Using this technique, optimized left hand circular polarization (LHCP) or right-hand circular polarization (RHCP) can be achieved with axial ratios near 1 by adjusting the meanderline polarizer rotation angles 11 and gridline polarizer rotation angle 21. A pure linear polarization state can also be achieved by adjusting the meanderline and gridline polarizer rotation angles. Since VICTS antennas inherently operate over near-hemispherical scan volumes, the combination of all three devices also provides optimum polarization performance over a near-hemispherical scan volume.

It is noted that the embodiment illustrated in FIGS. 3 and 4 is merely exemplary, and other embodiments are envisioned. For example, embodiments with different meanderline polarizer geometries, gridline geometries, and VICTS geometries are possible and may be used in place of those shown in FIGS. 3 and 4.

Advantages of the VICTS-based polarizer include that polarization is achieved in a low part count and in a very low-profile package (0.25 to 0.5 wavelength). Further, the combined meanderline-gridline polarizer can be fabricated using very low loss tangent materials combined with very high conductivity metals, which imparts very low dielectric and ohmic losses to transmitted waves. The VICTS-based polarizer may be designed for superior axial ratio performance (<1.25) with corresponding high cross-pol isolation (>18 dB) over a large scan volume by adjusting the rotation angles of the meanderline 10 and gridline polarizers 20. Additionally, the VICTS-based polarizer enables switching between two opposite senses of circular polarization (LHCP and RHCP) with identical performance. This is due at least in part to the symmetry of the combined VICTS-polarizer geometry.

Figure 5:
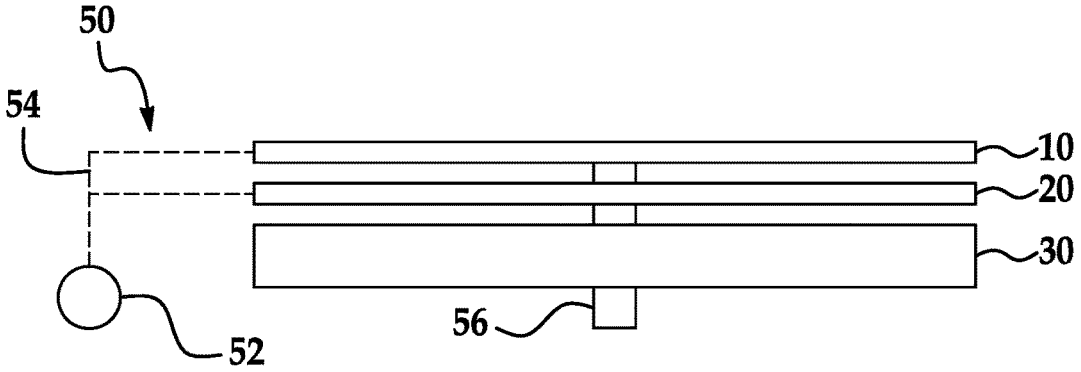
FIG. 5 is a schematic diagram illustrating a means for providing relative rotation between the meanderline and gridline polarizers.

As referenced above, the meanderline polarizer 10 and the gridline polarizer 20 can rotate relative to one another, for example, about a common axis. Briefly referring to FIG. 5, to effect such relative rotation a motive device 50 is operatively coupled to the meanderline polarizer 10 and/or the gridline polarizer 20. The motive device 50 may include, for example, a motor 52 (e.g., an electric motor) or other like device, and a drive coupler 54, such as a belt drive, a gear drive, a screw drive, spindle drive, etc. that couples the motor 52 to the polarizers 10, 20. In one embodiment, the polarizers 10, 20 are mounted to a spindle 56 that enables relative rotation between the respective polarizers about a common axis (e.g., they are axially rotatable about the spindle). In addition to or in lieu of a spindle, such rotation can also be achieved through the use of a bearing supporting the perimeter of each device.

Figure 6A:
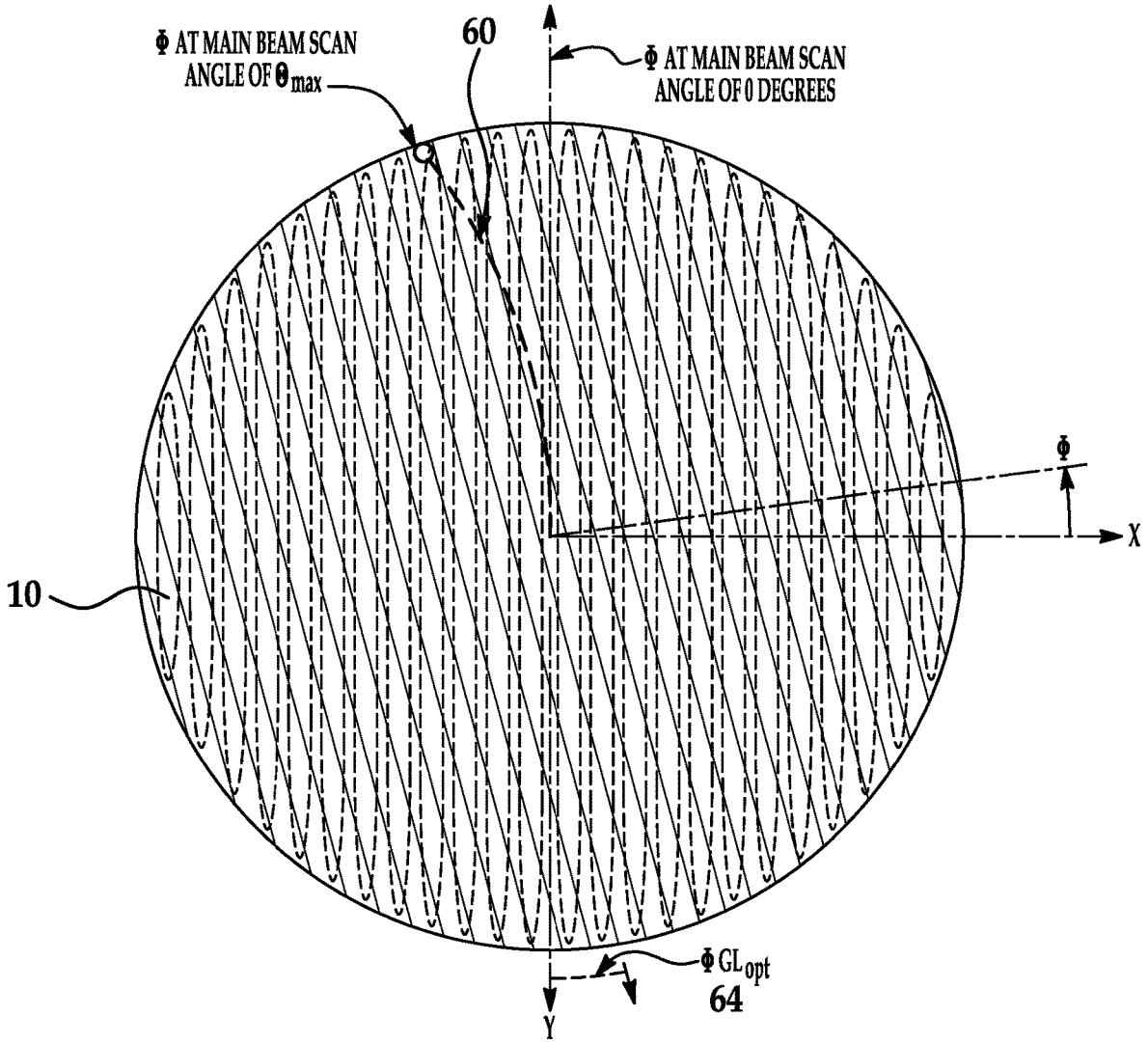
FIG. 6A is a top embedded view of an exemplary antenna system in accordance with the invention embedded in a spherical coordinate system, where the meanderline polarizer is omitted to show the VICTS aperture and gridline polarizer features.
Figure 6B:
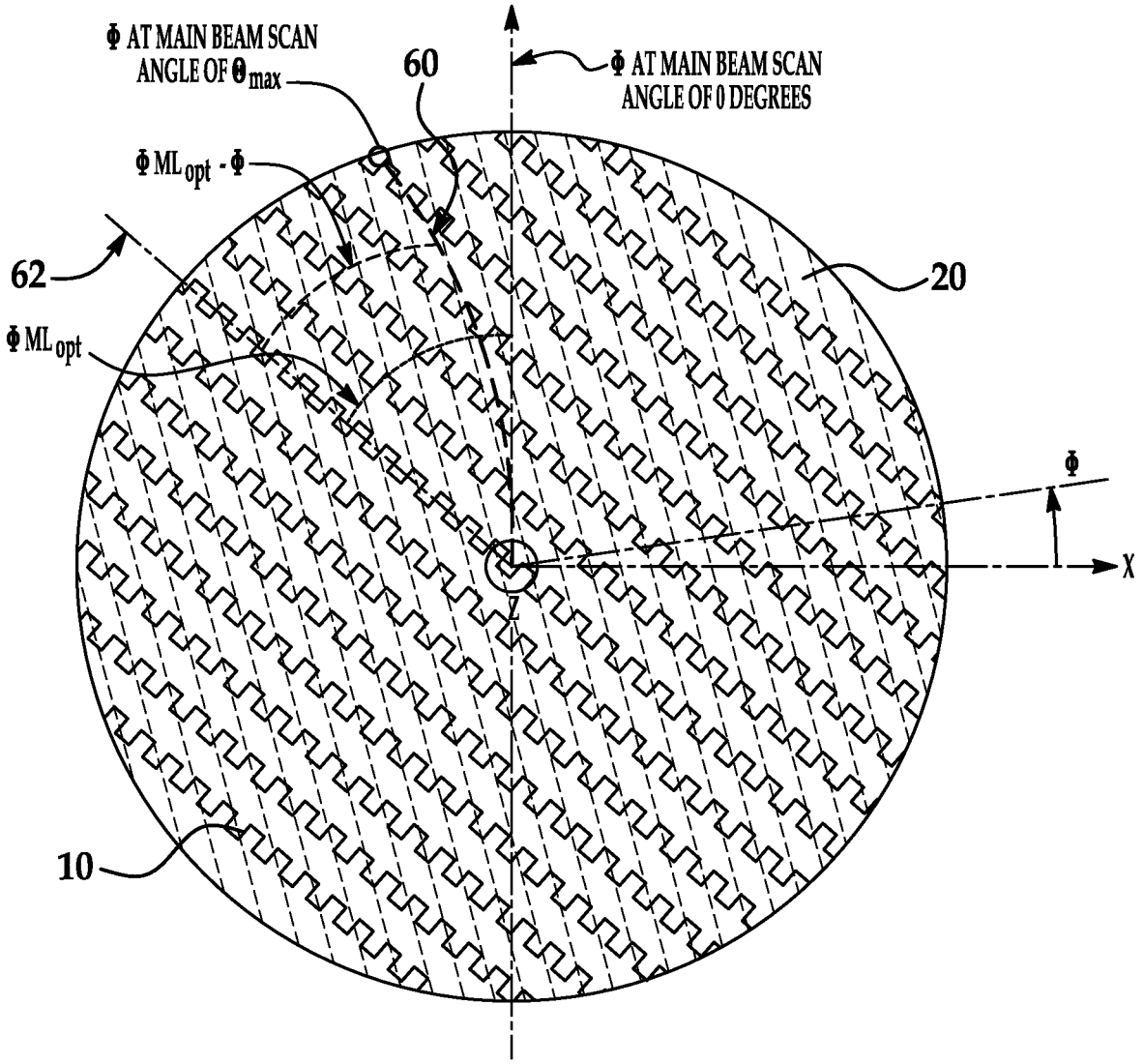
FIG. 6B is a top embedded view of an exemplary antenna system in accordance with the invention embedded in a spherical coordinate system showing the meanderline polarizer and the gridline polarizer features.

Referring now to FIGS. 6A and 6B, FIG. 6A illustrates a top view of an exemplary polarizer in accordance with the invention in a spherical coordinate system without the meanderline polarizer so that details of the gridline polarizer 30 and the VICTS aperture 29 (indicated with dashed lines) can be seen. FIG. 6B also shows a top view of the meanderline polarizer 10 and the gridline polarizer 20 (only) where the VICTS aperture and feed have been intentionally suppressed for clarity. FIGS. 6A and 6B each illustrate the Φ-beam position locus 60 for a typical VICTS antenna with the aperture fixed with respect to and embedded in a spherical coordinate system. In FIGS. 6A and 6B, rotation of the gridline polarizer 20 is relative to the stubs of the VICTS antenna 30 (the stubs being parallel to the y-axis), with the aperture 39 fixed with respect to and embedded in a spherical coordinate system.

Antenna main beam scanning is achieved in this case by rotating the VICTS feed 32 counter-clockwise. The main beam position is parallel to the z-axis (i.e., coming out of the page) for a differential feed to aperture rotation angle of zero degrees (i.e., $\theta=0°$, $\Phi=0°$). As the feed to aperture rotation angle is increased above zero degrees, the Φ angle position of the main beam follows the path of the position locus 60. In the embodiment shown in FIG. 6B, the meanderline rotation angle 62 is fixed with respect to the aperture at ΦMLopt degrees. Also, the gridline rotation angle 64 is fixed with respect to the aperture at ΦGLopt degrees as shown in FIG. 6A. As the feed rotates with respect to the aperture, the antenna beam scans from $\theta=0$ degrees to $\theta_{max}$ degrees in spherical coordinates. The difference between the optimum meanderline axis rotation angle and the Φ-path of the main beam, ΦMLopt-Φ varies and is synchronized with the difference needed to achieve optimum axial ratio versus scan. Similarly, the difference between the optimum gridline axis rotation angle and the Φ-path of the main beam, ΦGLopt-Φ varies and is synchronized with the difference needed to achieve optimum axial ratio.

Figure 7:
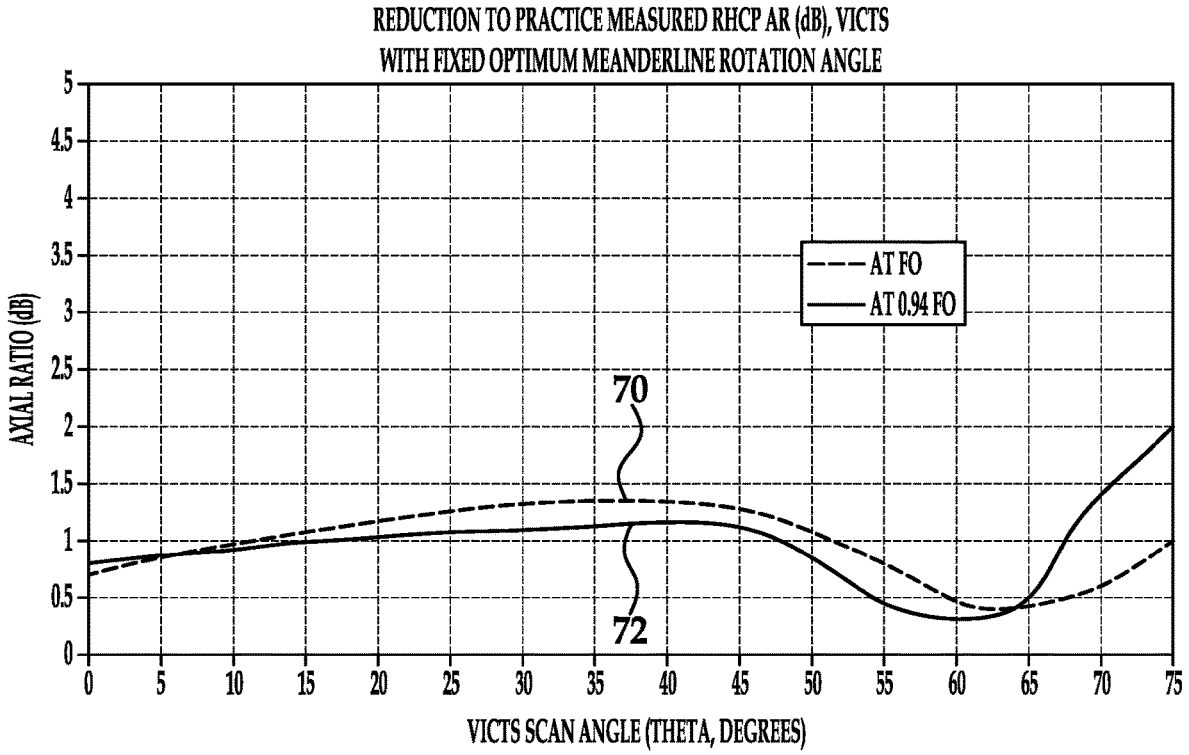
FIG. 7 is a graph illustrating measured axial ratio with a fixed meanderline rotation angle optimized at one scan angle of an antenna system in accordance with the invention.

FIG. 7 graphically illustrates measured axial ratio of an actual working device in accordance with the invention achieving an axial ratio below 2 dB out to $\theta=75$ degrees of scan over different frequencies 70 ($F_0$) and 72 ($0.94F_0$). Note also that the axial ratio versus theta is constant over all Φ angles (i.e., 0 to 360 degrees) since Φ-scanning of the main beam is achieved by rotating the feed 32, the aperture (obscured in FIG. 6), the gridline polarizer 20 and the meanderline polarizer 10 simultaneously, consistent with VICTS antenna architecture. Once the three angle profiles, i.e., the optimum meanderline polarizer rotation angle, the optimum gridline polarizer rotation angle, and the main beam Φ-beam position locus have been synchronized, the meanderline polarizer 10 and the gridline polarizer 20 may be affixed to the top of the aperture without further modification. Thus, this novel combination of VICTS antenna 30, gridline polarizer 20, and meanderline polarizer 10 achieves excellent axial ratio (and corresponding cross-polarization) characteristics in a low profile, low part-count package over nearly a hemisphere of scan volume.

Figure 8:
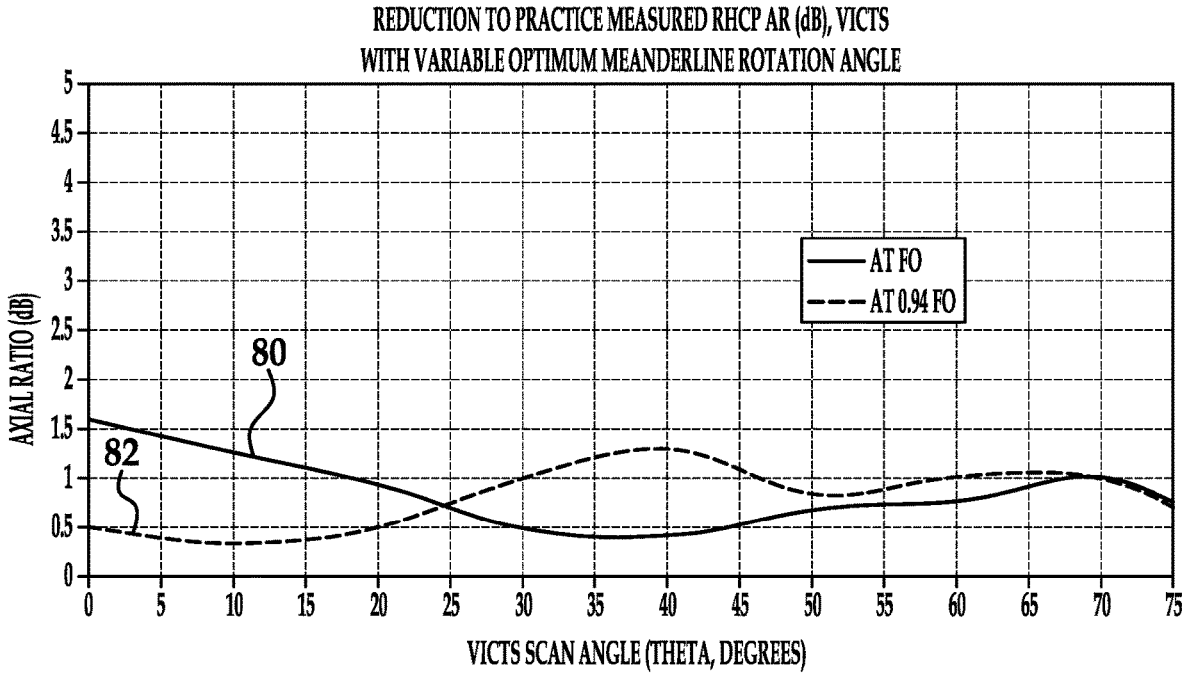
FIG. 8 is a graph illustrating measured axial ratio with a meanderline rotation angle optimized at each scan angle of an antenna system in accordance with the invention.

Additional improvements to axial ratio may be achieved by fabricating the meanderline polarizer 10 as a separate entity that is not affixed to the aperture 29 of the VICTS antenna 30. This allows the meanderline polarizer 10 to rotate above and with respect to the gridline polarizer 20, aperture 29 of the VICTS antenna 30, and feed 32. In this case, the meanderline axis rotation angle 62 for achieving optimum axial ratio can be synchronized with each individual scan angle in both θ and Φ to achieve better axial ratio than that achieved when the meanderline polarizer 10 is affixed to the aperture of the VICTS antenna 30 and gridline polarizer 20. FIG. 8 shows measured axial ratio of an actual working device in accordance with the invention achieving an axial ratio below 1.6 dB out to θ=75 degrees of scan (and 360 degrees in azimuth) for different frequencies 80 ($F_0$) and 82 ($0.94F_0$).

Further improvements to axial ratio may be achieved by fabricating both the meanderline polarizer 10 and gridline polarizer 20 as separate entities (not affixed to the aperture of the VICTS antenna 30) and allowing both to rotate above and with respect to the aperture and feed of the VICTS antenna. In this case, both the meanderline rotation angle 62 and the gridline rotation angle 64 for achieving optimum axial ratio can be synchronized with each individual scan angle in both Φ and θ to achieve better axial ratio than that achieved when both the meanderline polarizer 10 and the gridline polarizer 20 are affixed to the aperture of the VICTS antenna 30.

For both the approach where the meanderline polarizer 10 is allowed to rotate with respect to the aperture 29 of the VICTS antenna 30 and the gridline polarizer 20 is affixed to the aperture 29 of the VICTS antenna 30 and the approach where the meanderline polarizer 10 and the gridline polarizer 20 are allowed to rotate with respect to the aperture 29 of the VICTS antenna 30 and each other, the combination of VICTS antenna and polarizers may alternatively be deployed to provide linear polarization. Linear polarization is achieved by rotating the meanderline axis 18 and the gridline axis 28 to be parallel to the VICTS radiating element axis (parallel to the axis of the slots/stubs). This approach takes advantage of the nearly pure linear polarization characteristic of VICTS antennas. This implementation offers an embodiment with the selectable polarization characteristics that can meet the needs of multiple satellite constellations i.e. GEO/MEO/LEO.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

What is claimed is:

1. An antenna systems, comprising:

a planar antenna having a planar antenna aperture; and a linear-to-circular radio frequency (RF) polarizer including a meanderline polarizer including a plurality of meanderline conductor patterns, and a gridline polarizer including a plurality of conductors arranged in a grid pattern, wherein the gridline polarizer is spaced apart from the meanderline polarizer by a first prescribed distance and the gridline polarizer is spaced apart from the planar antenna aperture of the planar antenna by a second prescribed distance, the second prescribed distance different than the first prescribed distance, and wherein the meanderline polarizer is configured to provide a difference between an optimum meanderline axis rotation angle (ΦMLopt) and a Φ-path of the main beam (Φ) that varies with antenna scan angle, and wherein the gridline polarizer is configured to provide a difference between an optimum gridline axis rotation angle (ΦGLopt) and the Φ-path (Φ) of the main beam that varies with antenna scan angle.

2. The antenna system according to claim 1, wherein the meanderline polarizer and the gridline polarizer are concentric with one another.

3. The antenna system according to claim 1, wherein the meanderline polarizer and the gridline polarizer are rotatable relative to one another about a common axis.

4. The antenna system according to claim 1, wherein the meanderline polarizer and the gridline polarizer comprise a circular form factor.

5. The antenna system according to claim 1, further comprising a motive device operatively coupled to at least one of the meanderline polarizer or the gridline polarizer, the motive device operative to impart relative rotation between the gridline polarizer and the meanderline polarizer about a common axis.

6. The antenna system according to claim 5, wherein the motive device comprises a motor and at least one of a belt drive, a gear drive, direct drive, or a spindle coupling the motor to at least one of the gridline polarizer or the meanderline polarizer.

7. The antenna system according to claim 1, further comprising a spindle, wherein the meanderline polarizer and the gridline polarizer are connected to spindle and axially rotatable about the spindle.

8. The antenna system according to claim 1, wherein the meanderline polarizer comprises a plurality of layers stacked one above the other, each layer including a plurality of meanderline conductor patterns.

9. The antenna system according to claim 1, wherein the gridline polarizer comprises a plurality of layers, each layer including a plurality of conductors arranged in a grid pattern.

10. The antenna system according to claim 1, wherein a spacing between adjacent gridlines of the gridline polarizer is equal throughout the grid pattern.

11. The antenna system according to claim 1, wherein the gridlines of the gridline polarizer are parallel to one another.

12. The antenna system according to claim 1, wherein at least one of the meanderline polarizer or the gridline polarizer comprises at least one dielectric spacer arranged between adjacent layers of the respective polarizer.

13. The antenna system according to claim 12, wherein the dielectric spacer comprises at least one of air or low-density foam.

14. The antenna system according to claim 1, wherein the meanderline conductor pattern comprises at least one of a sinusoidal pattern, a curvilinear pattern or a square wave pattern.

15. The antenna system according to claim 1, wherein the meanderline polarizer comprises a first substrate and the gridline polarizer comprises a second substrate, and the meanderline conductor pattern is formed on the first substrate and the conductors arranged in a grid pattern are formed on the second substrate.

16. The antenna system according to claim 1, wherein the planar antenna comprises an aperture and feed, wherein the planar antenna is arranged relative to the polarizer to communicate RF signals between the aperture and the polarizer.

17. The antenna system according to claim 16, wherein the planar antenna comprises a variable inclination continuous transverse stub (VICTS) antenna.

18. The antenna system according to claim 16, wherein the planar antenna is spaced apart from the gridline polarizer by a prescribed distance.

19. The antenna system according to claim 16, wherein the gridline polarizer is arranged between the meanderline polarizer and the planar antenna.

20. The antenna system according to claim 16, further comprising a motive device operatively coupled to at least one of the meanderline polarizer, the gridline polarizer or the planar antenna, the motive device operative to provide relative motion between at least two of the meanderline polarizer, the gridline polarizer or the planar antenna.

21. The antenna system according to claim 1, wherein the meanderline polarizer is configured to synchronize the difference between the optimum meanderline axis rotation angle (ΦMLopt) and a Φ-path of the main beam (Φ) with a difference that produces optimum axial ratio versus antenna scan angle.

22. The antenna system according to claim 1, wherein the gridline polarizer is configured to synchronize the difference between the optimum gridline axis rotation angle (ΦGLopt) and the Φ-path (Φ) of the main beam with a difference that produces optimum axial ratio versus antenna scan angle.

* * * * *